US008070150B2

(12) United States Patent
Tanaka et al.

(10) Patent No.: US 8,070,150 B2
(45) Date of Patent: Dec. 6, 2011

(54) SHEET EJECTION DEVICE, IMAGE FORMING APPARATUS AND SHEET FINISHER PROVIDED THEREWITH

(75) Inventors: Yu Tanaka, Yokohama (JP); Hiroyuki Wakabayashi, Hachioji (JP); Masaaki Uchiyama, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 290 days.

(21) Appl. No.: 12/329,418

(22) Filed: Dec. 5, 2008

(65) Prior Publication Data

US 2009/0289412 A1 Nov. 26, 2009

(30) Foreign Application Priority Data

May 26, 2008 (JP) ..... 2008-136364

(51) Int. Cl.
*B65H 37/04* (2006.01)

(52) U.S. Cl. ..... 270/58.27; 270/58.11; 270/58.12; 270/58.17

(58) Field of Classification Search ..... 270/58.11, 270/58.12, 58.16, 58.17, 58.27
See application file for complete search history.

(56) References Cited

U.S. PATENT DOCUMENTS 5,857,670 A * 1/1999 Jung ..... 270/58.12
6,889,974 B2 * 5/2005 Tamura et al. ..... 271/220

FOREIGN PATENT DOCUMENTS

JP 2002-211829 A 7/2002
JP 2002-293472 A 10/2002
JP 2007-099430 A 4/2007

OTHER PUBLICATIONS

Japanese Office Action dated Feb. 16, 2010 and English translation thereof in counterpart Japanese Application No. 2008-136364.

* cited by examiner

*Primary Examiner* — Leslie A Nicholason, III
(74) *Attorney, Agent, or Firm* — Holtz, Holtz, Goodman & Chick. P.C.

(57) ABSTRACT

A sheet ejection device includes: a sheet ejection tray adapted to stack a sheet ejected thereon; an alignment member which aligns a position in a width direction and a direction perpendicular to a sheet ejection direction of the sheet on the sheet ejection tray; and a supporting unit which supports the alignment member so that the alignment member is displaced in a direction intersecting the sheet ejection direction when outer force is applied to the alignment member.

10 Claims, 7 Drawing Sheets

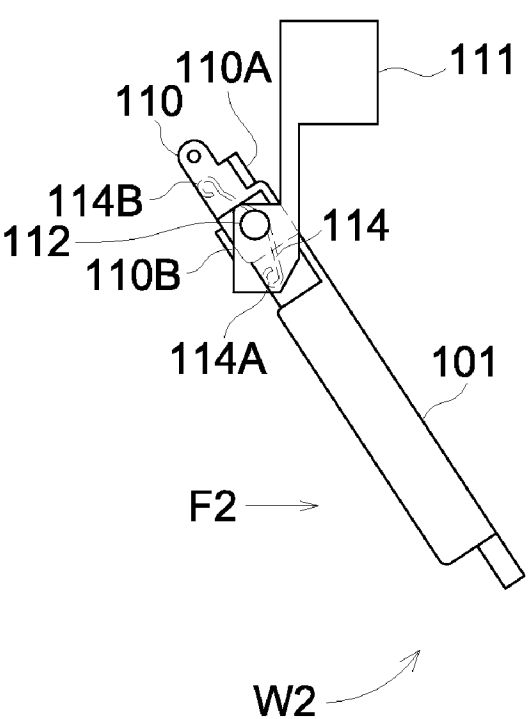
FIG. 9 ( c )
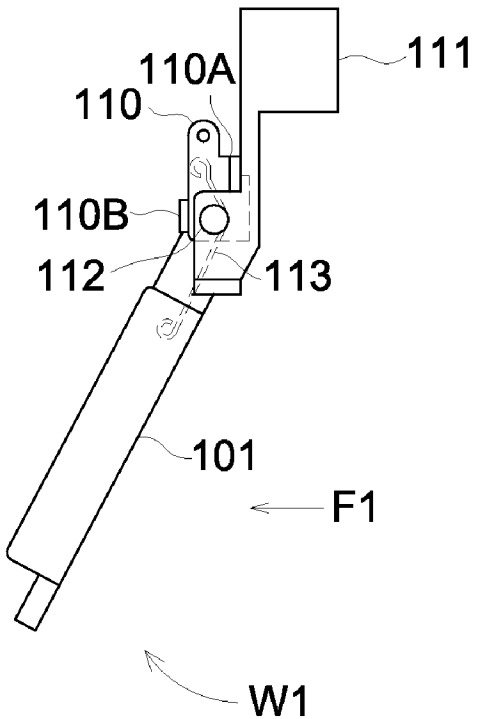
FIG. 9 ( b )
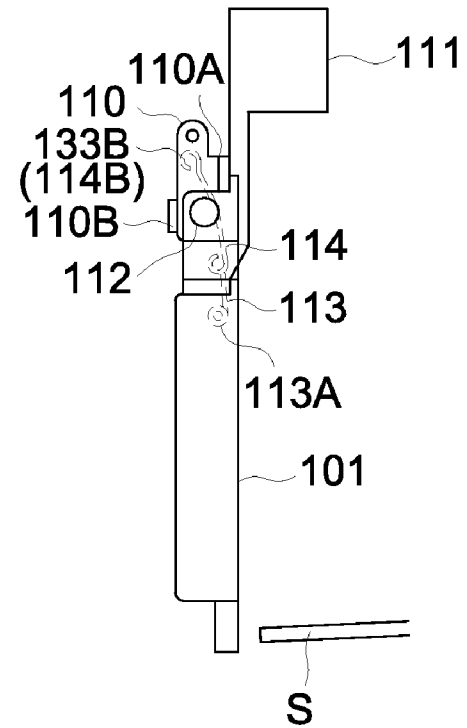
FIG. 9 ( a )

SHEET EJECTION DEVICE, IMAGE FORMING APPARATUS AND SHEET FINISHER PROVIDED THEREWITH

This application is based on Japanese Patent Application No. 2008-136364 filed on May 26, 2008, which is incorporated hereinto by reference.

BACKGROUND OF THE INVENTION

The present invention relates to a sheet ejection device that aligns a position of a sheet in its width direction on a sheet ejection tray, an image forming apparatus equipped with the sheet ejection device and a sheet finisher equipped with the sheet ejection device.

In a sheet ejection device that ejects a large quantity of sheets, the large quantity of sheets are ejected on a sheet ejection tray and are stacked, and after that, a bundle of sheets is given processing treatment. Therefore, the plenty of sheets are sometimes conveyed to another processor. In that case, a bundle of sheets prior to the processing treatment is required to have high compatibility. Accordingly, there is known a sheet ejection device equipped with an alignment member that aligns a bundle of sheets stacked on the sheet ejection tray.

Further, there is available a sheet ejection device by which a bundle of sheets is moved through shifting to a different position in the direction perpendicular to a sheet ejecting direction in a unit of one set of sheets so that dividing of sheets stacked on the sheet ejection tray in a unit of one set may become easy. In the sheet ejection device having the shifting function of this kind, high compatibility is required for each bundle of sheets at each shifting position.

Further, an image forming system that contains an image forming apparatus and is capable of processing at high speed is in a trend to be used as a shortrun printing apparatus, and when it is used as a shortrun printing apparatus, there is a growing trend wherein the image forming system is required to have capabilities to align a sheet on which an image has been formed with a sheet which has been processed by another apparatus to eject them.

In Unexamined Japanese Patent Application Publication No. 2002-211829, there is proposed to shift under the highly-aligned configuration and thereby to integrate by providing a shifting function on a sheet ejection tray.

In the case of a high-speed image forming apparatus and an image forming system composed of a high-speed image forming apparatus and a sheet finisher, a large quantity of sheets are integrated on a sheet ejection tray.

An integrated sheet is conveyed from a sheet ejection tray to another processing station, to be sent to the succeeding processing progress.

When conveying a sheet from a sheet ejection tray to the succeeding processing progress, the sheet is taken out of the sheet ejection tray manually in many cases.

However, handling of a sheet having a large volume and large mass is not easy, and there are sometimes generated accidents including destroyed alignments caused by contact between aligned sheets and surrounding mechanical parts, and injuries caused by contact between an operator's hand and mechanical parts.

In particular, when an alignment member is provided at the position near a sheet ejection tray, the number of chances to come in contact with the alignment member grows greater.

The alignment device disclosed in Unexamined Japanese Patent Application Publication No. 2002-211829 is not equipped with a safety device for the aforesaid accidents.

SUMMARY OF THE INVENTION

An aspect of the invention is as follows.

1. A sheet ejection device equipped with a sheet ejection tray on which ejected sheets are stacked and an alignment member that aligns positions of the ejected sheets in their width directions, which is characterized to have a supporting unit that supports the aforesaid alignment member so that the alignment member may be displaced in the direction for the alignment member to intersect the direction of ejection for sheets when an external force is applied on the alignment member.

2. An image forming apparatus is characterized to have a sheet ejection device described in the Item 1 above.

3. A sheet finisher is characterized to have a sheet ejection device described in the Item 1 above.

Each of FIGS. 9(*a*)-9(*c*) is a diagram showing a safety mechanism of a shifting section showing a safety mechanism of an alignment member.

DETAILED DESCRIPTION OF THE PREFERRED EMBODIMENT

Figure 1:
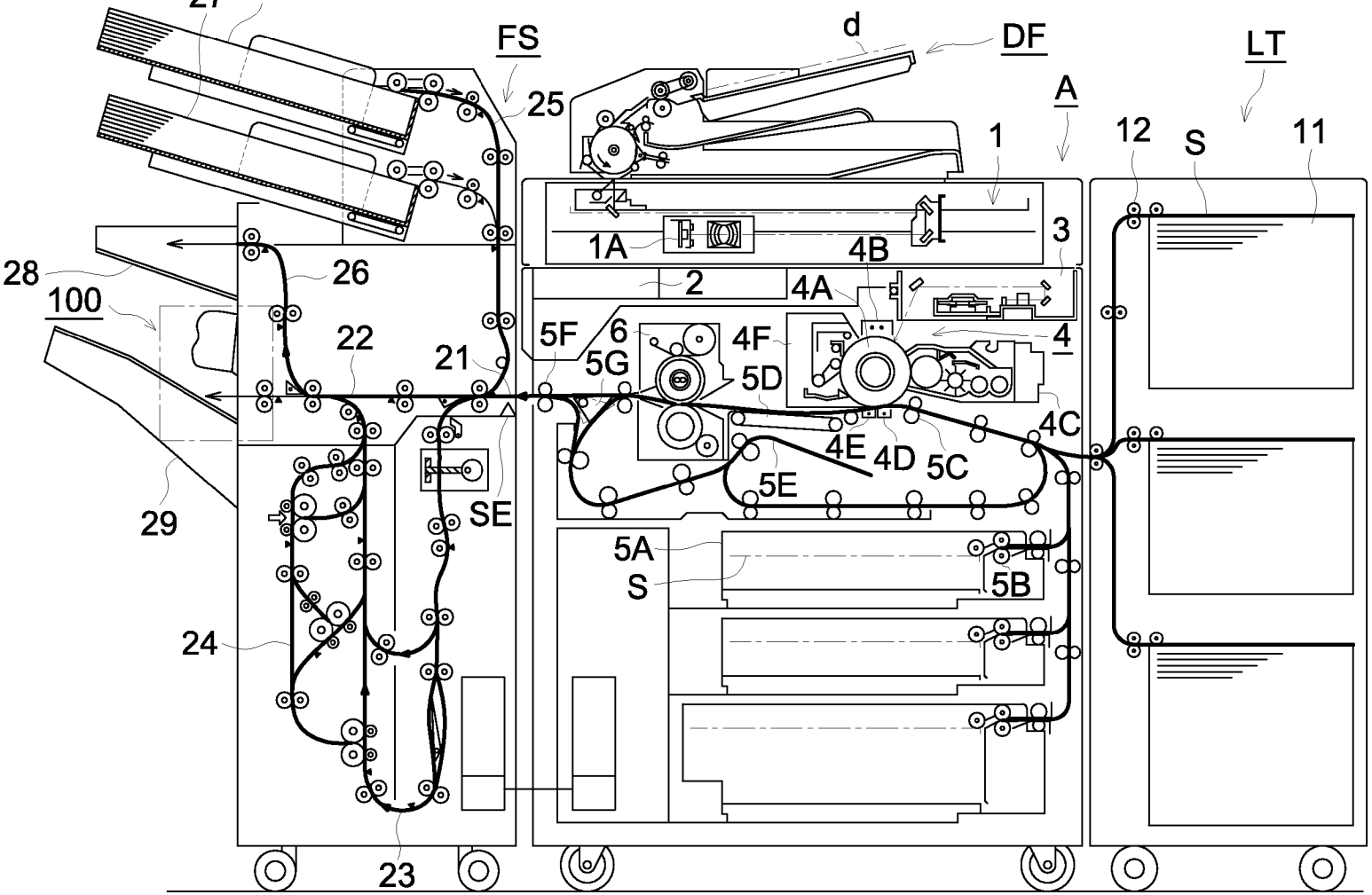
FIG. 1 is a diagram showing an overall structure of an image forming system equipped with a sheet ejection device relating to the embodiment of the invention.

FIG. 1 is a diagram showing an overall structure of an image forming system composed of image forming apparatus A, automatic document feeder DF, sheet finisher FS and large capacity sheet feeding device LT.

The illustrated image forming apparatus A is equipped with image reading section 1, image processing section 2, image writing section 3, image forming section 4, a sheet conveying section and fixing device 6.

The image forming section 4 is composed of photoreceptor drum 4A, charging unit 4B, developing unit 4C, transfer unit 4D, separation unit 4E and cleaning unit 4F.

The sheet conveying section is composed of sheet feed cassette 5A, first sheet feed section 5B, second sheet feed section 5C, first conveyance section 5D, second conveyance section (automatic two-sided copy conveyance section) 5E and sheet ejection section 5F.

Sheet finisher FS is connected to the sheet ejection section 5F side on the illustrated left side of the image forming apparatus A.

Images on one side or both sides of document "d" placed on a document table of the automatic document feeder DF are read out by an optical system of the image reading section 1, and are read in by CCD image sensor 1A.

Analog signals converted photo-electrically by CCD image sensor 1A are subjected to processing such as analog processing, A/D conversion, shading correction and image compression processing, in image processing section 2, and are stored in an image memory (not shown).

In image writing section 3, photoreceptor drum 4A of the image forming section 4 is irradiated with light outputted from a semiconductor laser, and a latent image is formed. In the image forming section 4, there are carried out treatments such as charging, exposure, developing, transfer, separation and cleaning. An image is transferred by transfer unit 4D onto sheet S that is fed from the sheet feed cassette 5A and from the large capacity sheet feeding device LT by the first sheet feed section 5B. The sheet S carrying the image is subjected to fixing processing by the fixing device 6, and is fed into sheet finisher FS from sheet ejection section 5F.

The sheet S which has been subjected to the fixing processing is fed into second conveyance section 5E by conveyance path switching plate 5G, then, is fed again and in the image forming section 4, and it is ejected from sheet ejection section 5F after being subjected to image forming on the reverse side of the sheet S.

The large capacity sheet feeding device LT is composed of sheet stacking unit 11 and of first sheet feed unit 12, and it stores a large number of sheets S stacked, and feeds sheet S into image forming apparatus A.

The sheet finisher FS is one that conducts folding processing and shifting processing for sheet S and addition sheet F to eject them to fixed sheet ejection tray 28 or to rising and falling sheet ejection tray 29.

The sheet finisher FS is equipped with sheet carry-in section 21, horizontal conveying section 22, lower conveying section 23, folding processing section 24, addition sheet conveying section 25 and with upper conveying section 26.

Sheet S ejected from the image forming apparatus A passes through the horizontal conveyance section 22 and the upper conveying section 26 to be ejected to fixed sheet ejection tray 28, or passes through the horizontal conveyance section 22 to be ejected to the rising and falling sheet ejection tray 29, or passes through the lower conveying section 23 to be ejected to the rising and falling sheet ejection tray 29 after being subjected to the folding processing in the folding processing section 24.

Addition sheets F such as sheets for interleaf and sheets for a cover are stored in addition sheet feed section 27, and addition sheets F are added to recording sheets coming from the image forming apparatus A, and they pass through the aforesaid conveyance section to be ejected to the rising and falling sheet ejection tray 29.

Sheets S are ejected to the fixed sheet ejection tray 28, in the mode to form a small number of images and in the image forming mode wherein neither folding processing nor shifting processing is carried out.

Under the modes including a folding mode, a mode of forming a large quantity of images for forming a large number of image sheets, and a shifting sheet ejection mode, sheets S and addition sheets F are ejected to the rising and falling sheet ejection tray 29.

The folding processing section 24 is equipped with functions to conduct various types of folding processing such as twofold and various types of folding in three, as is widely known, whereby, folded sheets S and addition sheets F are conveyed upward, and then, are ejected in the rising and falling sheet ejection tray 29 by sheet ejection roller 30 provided on horizontal conveying section 22.

Sheet ejection device 100 including the rising and falling sheet ejection tray 29 is equipped with shifting sheet ejection functions.

Next, the sheet ejection device 100 having shifting sheet ejection functions will be explained as follows.

Incidentally, in the following explanation, sheet S includes addition sheet F.

Figure 2:
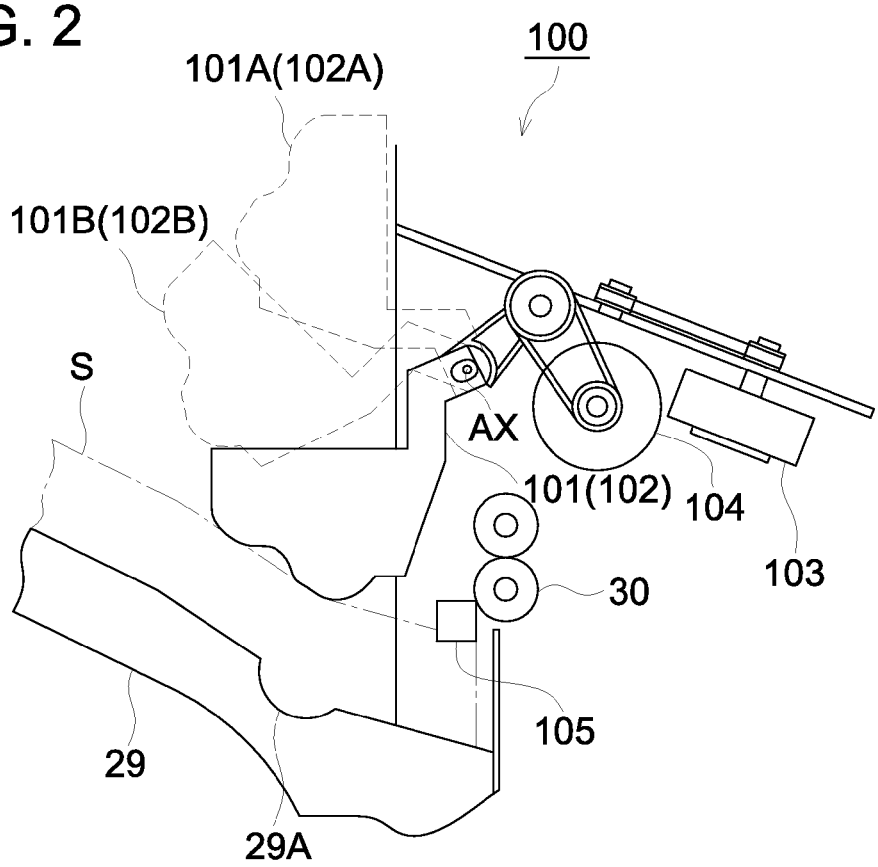
FIG. 2 is a front sectional view of sheet ejection device 100.

FIG. 2 is a front sectional view of sheet ejection device 100.

The sheet ejection device 100 is structured to be a sheet ejection device of sheet finisher FS. However, it is also possible to make it to be a sheet ejection device of image forming apparatus A.

As stated above, sheet S and addition sheet F are ejected to rising and falling sheet ejection tray 29 representing a sheet ejection tray, and in the following explanation, a general name of sheet S is given to both of the sheet S and the rising and falling sheet ejection tray 29.

Though the sheet S ejected by sheet ejection roller 30 is ejected to the rising and falling sheet ejection tray 29, as stated above, FIG. 2 shows sheet S stacked on the rising and falling sheet ejection tray 29.

An upper surface of the sheet S is detected by sensor 105 that is composed of a photo-electronic sensor, and the rising and falling sheet ejection tray 29 is moved up and down so that the upper surface of the sheet S may be kept constantly at the fixed height. The up-and-down movement of the rising and falling sheet ejection tray 29 of this kind is carried out by a drive of a motor (not shown) controlled by a controller.

On the rising and falling sheet ejection tray 29, there is formed concave portion 29A that is positioned just beneath alignment members 101 and 102.

When sheet S is stacked on the rising and falling sheet ejection tray 29, there is formed a gap between the sheet S and the rising and falling sheet ejection tray 29, by the concave portion 29A as illustrated.

When an operator takes sheet S out of the rising and falling sheet ejection tray 29, it is possible to take out sheet S by inserting a hand into the gap formed by the concave portion 29A.

Above the rising and falling sheet ejection tray 29, there are arranged side by side a pair of plate-like alignment members 101 and 102 which align sheet S in a horizontal direction (hereinafter referred to as width direction) that is perpendicular to the direction for conveyance and ejection of sheet S.

The paired alignment members 101 and 102 can swivel in the direction to recede from the rising and falling sheet ejection tray 29 around axis of gyration AX, and they are established at an alignment position shown with solid lines, a first receding position shown with dotted lines (101A, 102A) and a second receding position shown with dotted lines (101B, 102B).

The alignment members 101 and 102 are swiveled by a drive of motor 104 and are established at the aforesaid alignment position, first receding position and a second receding position.

At the alignment position shown with solid lines, the empty weight of the alignment member 101 or 102 makes it to be on sheet S.

The alignment members 101 and 102 reciprocate in the width direction of sheet S as will be explained later, and this reciprocating movement is conducted by a drive of motor (shift member) 103 in which the driving force of the motor 103 is transmitted to the alignment members 101 and 102 through a transmission mechanism employing a belt and a pulley.

Positions of rotation of the alignment members 101 and 102, in particular, alignment positions, the first receding position and the second receding position are set based on signals outputted by sensor 106 (shown in FIG. 3) composed of the photo-electronic sensor.

Figure 3:
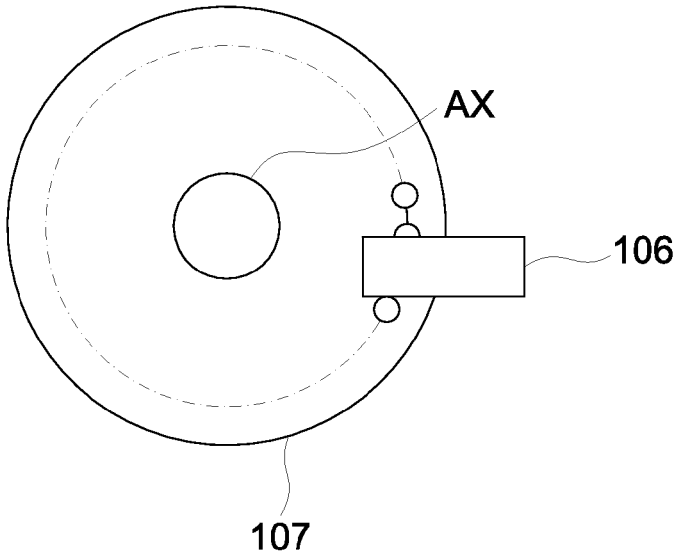
FIG. 3 is a diagram showing a mechanism to detect a height of an alignment member.

FIG. 3 shows a mechanism that constitutes a detecting device which detects a height of each of alignment members 101 and 102. Encoder 107 is fixed on axis of gyration AX for alignment members 101 and 102, and sensor 106 detects a position of rotation of the encoder 107.

Figure 4:
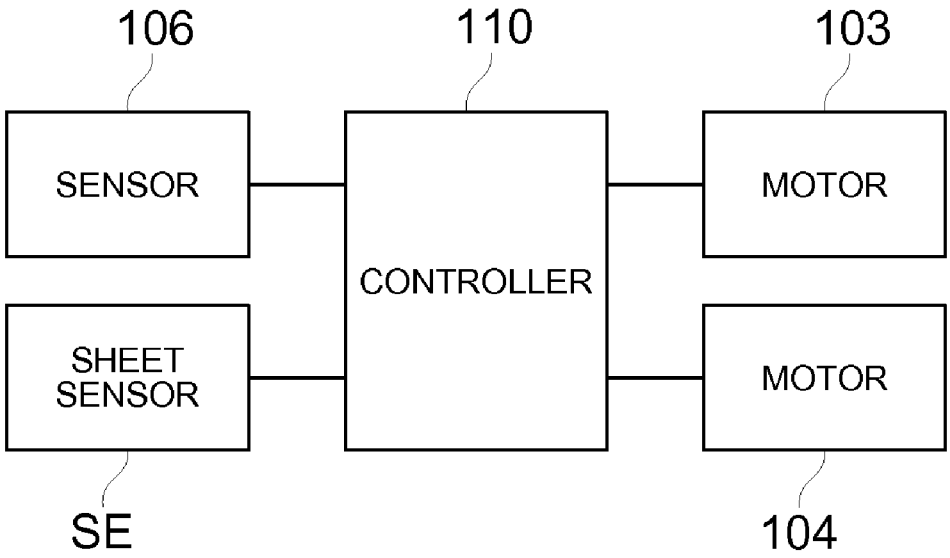
FIG. 4 is a block diagram of a controlling system that conducts shifting control.

FIG. 4 is a block diagram of a control system that conducts shifting sheet ejection control in sheet ejection device 100. In the drawing, the numerals 103 and 104 represent motors which drive respectively alignment members 101 and 102, as explained earlier, and 106 represents a sensor that detects positions of rotations of alignment members 101 and 102.

SE represents a sheet sensor provided at sheet carry-in section 21 in FIG. 1.

Controller 110 conducts shifting control based on detection signals of sensor 106 and of sheet sensor SE.

Next, shifting control will be explained, referring to FIG. 5.

Figure 5:
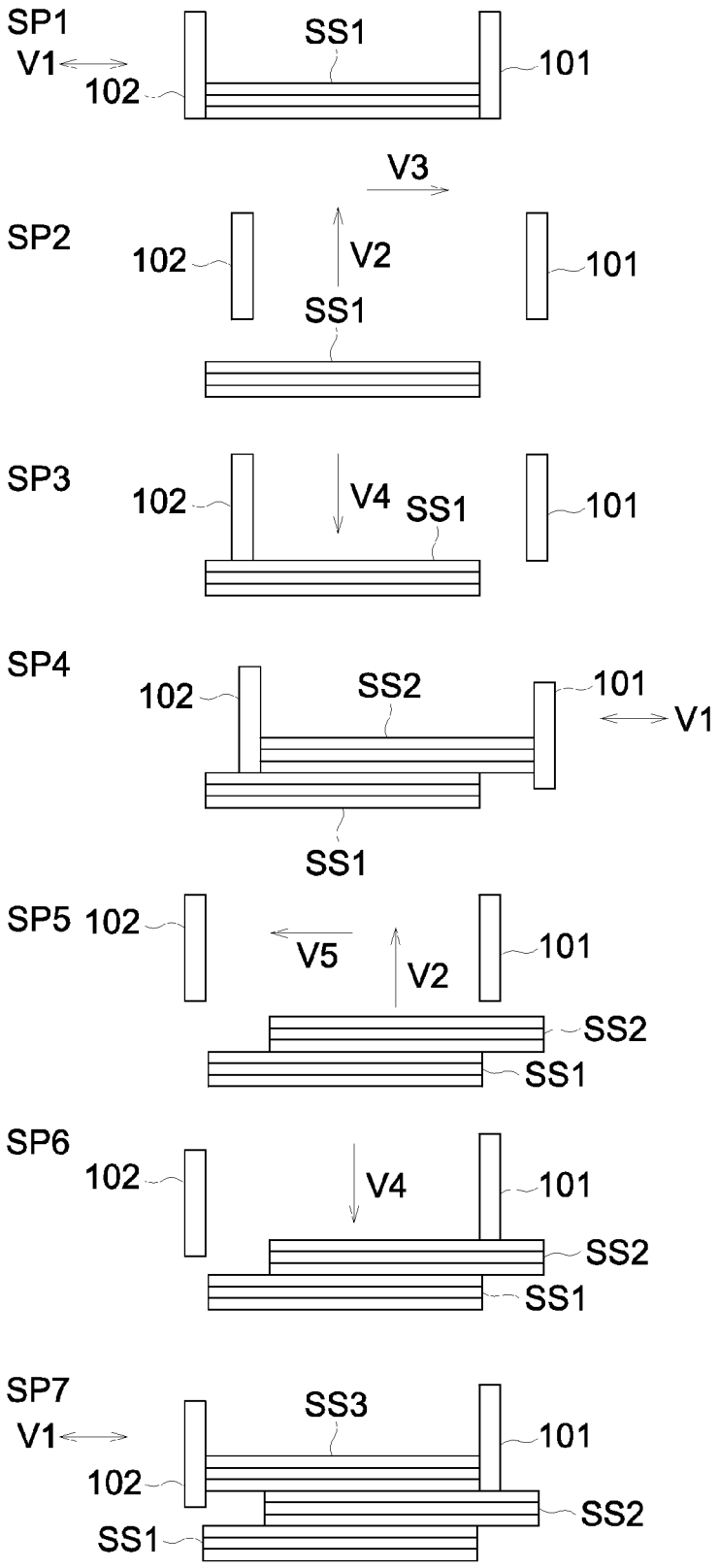
FIG. 5 is a diagram showing a shifting process.

In FIG. 5, directions shown by arrow V1, V3 and V5 represent a first direction that is perpendicular to the conveyance ejection direction for sheet S and is in parallel with sheet surface on the rising and falling sheet ejection tray 29 (hereinafter referred to as width direction).

Bundle of sheets SS1 in quantity of sheets constituting one unit of an established shift is stacked on the rising and falling sheet ejection tray 29, as shown in step SP1.

In the step SP 1, alignment members 101 and 102 are set to the alignment height that is a lower position shown with solid lines in FIG. 2. This lower position is a position where a position of a lower end of alignment members 101 and 102 is slightly lower than a sheet supporting surface for the sheet of the rising and falling sheet ejection tray 29.

Therefore, when the alignment member 101 or 102 is set to the lower position, the empty weight thereof makes it to be existent on the rising and falling sheet ejection tray 29.

The alignment member 102 reciprocates in the width direction of sheet as shown with arrow V1 to align sheet S. Sheet alignment is carried out in a way that the alignment member 102 moves each time a sheet of the sheet S is ejected.

At a step when bundle of sheets SS1 arrives at the established number of sheets, which is notified by signals coming from sheet sensor SE, alignment members 101 and 102 move by about 2 mm outwards in step SP2 to part from the side edge of bundle of sheets SS1, and then, the alignment members rise as shown with arrow V2. Incidentally, "outwards" means a direction toward an outside from the center of sheet S in terms of its width direction.

A distance of the movement shown with arrow V2 is a distance by which a lower end of each of alignment members 101 and 102 parts from the upper surface of the bundle of sheets SS1.

In step SP2, alignment members 101 and 102 are set to a receding height at which the alignment members are away from the upper surface of the bundle of sheets SS1.

In the meantime, the receding height of the alignment members 101 and 102 shown in step SP2 corresponds to the second receding position in FIG. 2.

The second receding position shown with 101B and 102B in FIG. 2 is lower than the first receding position (shown with 1-1A and 102A) at which the alignment members 101 and 102 are positioned when sheet ejection device 100 is in the shutdown condition.

After rising, the alignment members 101 and 102 moves horizontally toward the right side (in the width direction) as shown with arrow V3. A distance of the movement shown with arrow V3 is a distance corresponding to an amount of shifting.

Next, as shown in step SP3, the alignment members 101 and 102 fall as shown with arrow V4.

The alignment members 101 and 102 fall so that their lower edges may become lower slightly than the upper surface of the bundle of sheets SS1. As a result, the alignment member 102 mounts on the bundle of sheets SS1, and the lower edge of the alignment member 101 becomes to be slightly lower than the uppermost surface of sheet S.

In step SP4, the alignment member 101 reciprocates in the width direction as shown with arrow V1, to align a sheet.

Step SP5 is a step identical to step SP2 wherein alignment members 101 and 102 rise as shown with arrow V2, and then, move horizontally toward the left side as shown with arrow V5.

In step SP6 following the step SP5, alignment members 101 and 102 fall as shown with arrow V4, to be set at shifted alignment positions.

In succeeding step SP7, alignment member 102 reciprocates as shown with arrow V1, to align sheet S.

Bundles of sheets SS1, SS2 and SS3 which have been subjected to shifting processing by aligning processes in steps SP1-SP7 are formed.

Figure 6:
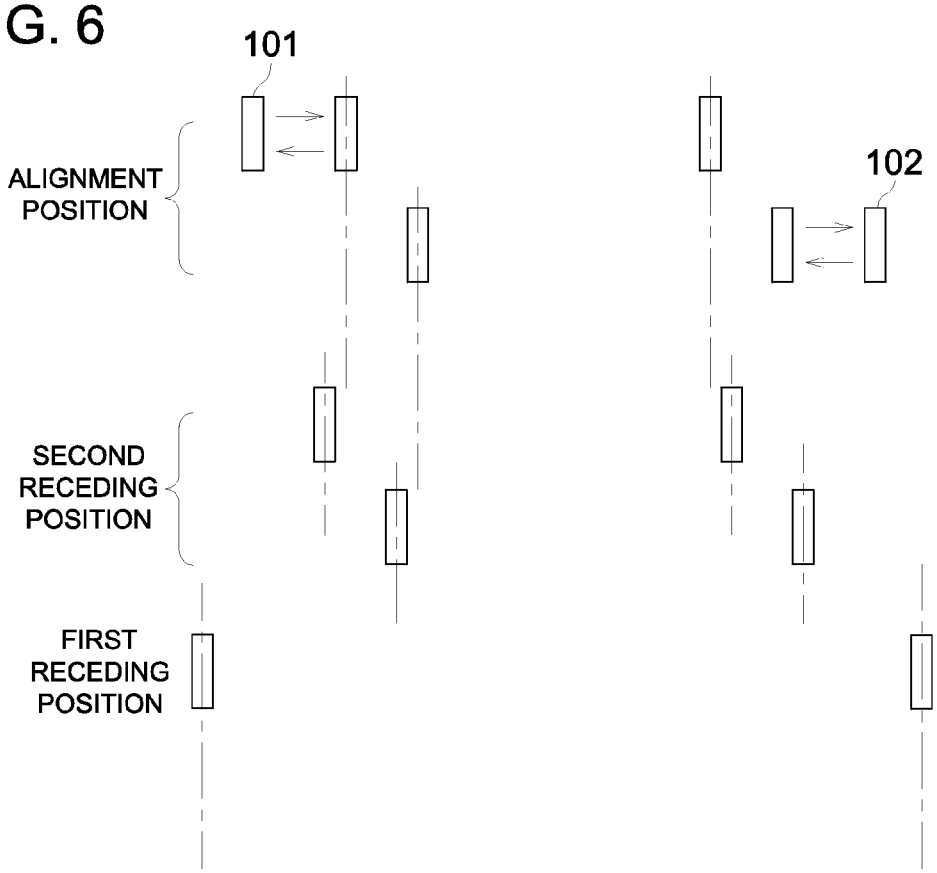
FIG. 6 is a diagram showing an alignment position, the first receding position and the second receding position.

In FIG. 6, alignment positions of alignment members 101 and 102, the first receding position and the second receding position as positions in the width direction.

As illustrated, the first receding position is on the outside of the second receding position in terms of the width direction.

Namely, the first receding position is a position in the case when the alignment members 101 and 102 are in the standby state, and the first receding position is set to be outside of the operation range of the aforesaid position.

Further, the second receding position is a position wherein each of the alignment members 101 and 102 is shifted outward slightly (for example, 2 mm) from the alignment position, as stated earlier.

The alignment members 101 and 102 are set to the home position, namely, the first receding position, based on signals of sheet ejection completion.

In this case, each of the alignment members 101 and 102 is at the outside of an operation range parting greatly from the rising and falling sheet ejection tray 29 as shown in FIG. 2, and it is set to be high and to the position in the outside in the width direction as shown in FIG. 6.

Figure 7:
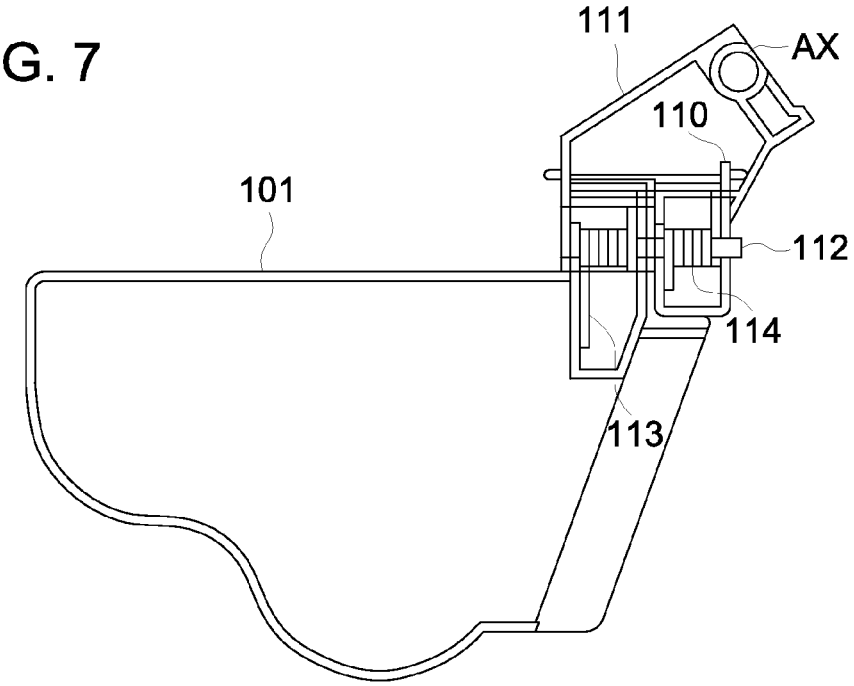
FIG. 7 is a diagram showing a safety mechanism of a shifting section showing a safety mechanism of an alignment member.
Figure 8:
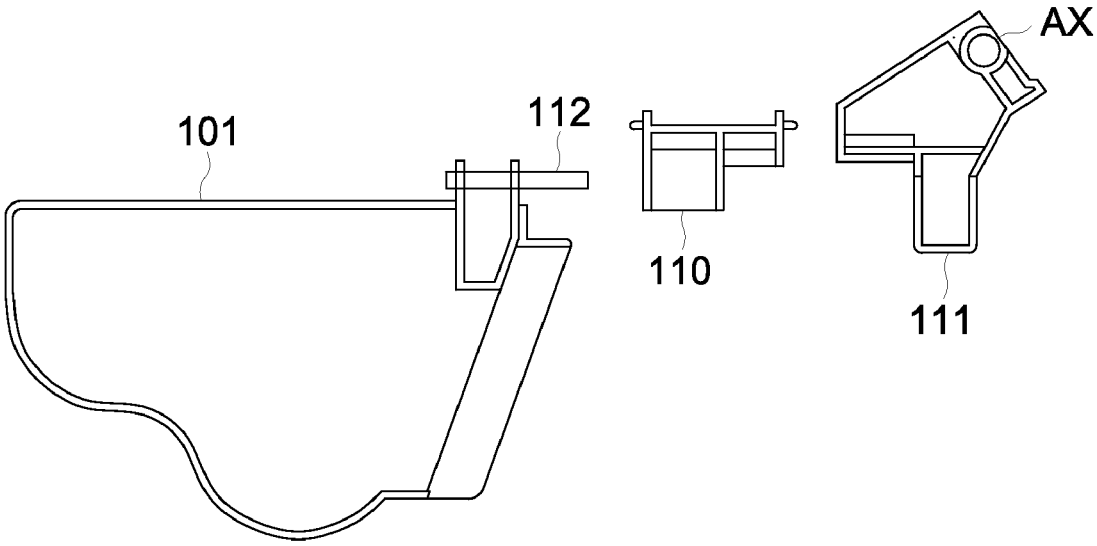
FIG. 8 is a diagram showing a safety mechanism of a shifting section showing a safety mechanism of an alignment member.

Each of FIGS. 7-9(*c*) shows a safety mechanism for the alignment member.

FIG. 7 is a front elevation of alignment member 101, FIG. 8 is an exploded view of an installing structure for the alignment member and each of FIGS. 9(*a*)-9(*c*) is a plane view of the alignment member viewed from the upper part and it is a diagram showing operations of the safety mechanism. In the mean time, a safety mechanism shown in FIGS. 7-9(*c*) and explained as follows is one for alignment member 101, and a safety mechanism that is the same as the aforesaid safety mechanism is provided also on alignment member 102.

The alignment member 101 has shaft 112 on the edge portion on the upstream side in the sheet ejection direction, and it is attached on intermediate supporting member 110 and on supporting member 111 by which the alignment member 101 is attached on a sheet finisher. Namely, the alignment member 101 is connected with the intermediate supporting member 110 and with the supporting member 111, y getting the shaft 112 that forms a base portion of the alignment member 101 through a hole (not shown) of the intermediate supporting member 110 and through a hole provided on the supporting member 111.

Coil springs 113 and 114 are wound around the shaft 112.

A bottom end of the coil spring 113 is fixed on the alignment member 101, and its top end is fixed on the intermediate supporting member 110.

Further, a bottom end of the coil spring 114 is fixed on the supporting member 111, and its top end is fixed on the intermediate supporting member 110.

On the right side of the intermediate supporting member 110 in each of FIGS. 9(*a*)-9(*c*), there is formed projection 110A, and on the left side thereof, there is formed projection 110B.

The projection 110A hits the supporting member 111, while, the projection 110B hits the alignment member 101.

The alignment member 101 can swivel around the shaft 112. The shaft 112 is in parallel with a sheet ejection direction in FIG. 2.

Namely, the alignment member 101 can swivel in the second direction around the shaft that is in parallel with a sheet ejection direction.

FIG. 9(*a*) shows a posture of the alignment member 101 on the occasion when no external force is applied, FIG. 9(*b*) shows a posture of the alignment member 101 on the occasion when external force shown with F1 is applied, and FIG. 9(*c*) shows a posture of the alignment member 101 on the occasion when external force shown with F2 is applied.

When external force F1 is applied on the alignment member 101, the alignment member 101 swivels clockwise as shown with W1. The direction W1 is a direction toward the outside for the sheet stacking area (sheet width area) on rising and falling sheet ejection tray 29, namely, it is a direction toward the outside from the center in the width direction. The relationship between sheet S on the rising and falling sheet ejection tray 29 and the alignment member 101 is as shown in FIG. 9(*a*). As is illustrated, the direction W1 is a direction to be displaced toward the outside while being pressed by an edge portion of sheet S in the width direction.

In the case of swiveling shown in FIG. 9(*b*), an engagement action of projection 110A prevents intermediate supporting member 110 from swiveling. Therefore, there is caused relative swiveling between the alignment member 101 and the intermediate supporting member 110.

For this relative swiveling, stress of coil spring 113 acts upon the swiveling as resisting force.

Accordingly, if the external force F1 is removed, the alignment member 101 returns to the state shown in FIG. 9(*a*).

Namely, when sheet S or a hand of an operator comes in contact with alignment member 101 in the course of operation to take out sheet S from rising and falling sheet ejection tray 29, the alignment member 101 swivels as shown with arrow W1, but it makes its comeback if contact is broken off.

When external force F2 is applied on the alignment member 101, the alignment member 101 swivels counterclockwise as shown with arrow W2. The direction W2 is a direction toward the inside for the sheet stacking area (sheet width area) on rising and falling sheet ejection tray 29.

In the case of swiveling shown in FIG. 9(*c*), an engagement action of projection 110B of the intermediate supporting member causes intermediate supporting member 110 and he alignment member 101 to swivel integrally, and the intermediate supporting member 110 swivels relatively to he supporting member 111.

For this relative swiveling, stress of coil spring 114 acts upon the swiveling as resisting force.

Accordingly, if the external force F2 is removed, the alignment member 101 returns to the state shown in FIG. 9(*a*).

Namely, when sheet S or a hand of an operator comes in contact with alignment member 101 in the course of operation to take out sheet S from rising and falling sheet ejection tray 29, the alignment member 101 swivels as shown with arrow W1 and arrow W2, but it makes its comeback if contact is broken off. The meantime, after completion of ejection of sheets for series of jobs on rising and falling sheet ejection tray 29, the alignment member recedes upward to part from the rising and falling sheet ejection tray after conducting the last aligning operations. Therefore, even when external force shown with F2 is applied on the alignment member during operations to take out sheet S, and even when the alignment member swivels in the inner direction W2 for a sheet stacking area on rising and falling sheet ejection tray 29, it does not happen that the alignment member hits a bundle of sheets stacked on the rising and falling sheet ejection tray 29, and the alignment is disturbed accordingly.

The supporting mechanism of the alignment member 101 explained above, namely, intermediate supporting member 110 that supports the alignment member 101 to be capable of being displaced in the second direction, supporting member 111, and coil springs 113 and 114 constitute a supporting device that supports the alignment member.

As stated above, for alignment member 101, a mechanism is one wherein the alignment member 101 always recedes independently of the direction for right and left for external force to be applied, thus, destruction of alignment of sheets can be prevented, and a safety mechanism that prevents injuries of an operator can be provided at a sheet ejection section.

Incidentally, it is preferable to use coil spring 113 having the spring constant wherein displacement resisting force in the case for alignment member 101 to be displaced in W1 direction is greater than the stress from the sheet receiving in the case of alignment conducted when alignment member 101 is in contact with a sheet on rising and falling sheet ejection tray 29. The alignment member 101 reciprocates in the width direction to align the sheets as shown in FIG. 6, and in the alignment operations, the alignment member 101 receives the force toward the outside in the width direction caused by the stress of the sheet, namely, the force F1 shown in FIG. 9(*b*). In the alignment operations, it is not desirable that the alignment member 101 is displaced by the force received from the sheet. By making displacement resisting force in the case when the alignment member 101 is displaced in the direction of W1 to be greater than the stress received from sheets in the case of alignment, it is possible to secure safety while securing the sufficient alignment operations.

On the other hand, for the force toward the inside in the width direction, it is preferable that the alignment member 101 is displaced easily. To satisfy the conditions of that kind, it is also possible to establish the spring constant of the coil spring 113 to be higher than that of coil spring 114, and thereby to make the displacement resisting force in the case of displacement in the direction of W1 and the displacement resisting force in the case of displacement in the direction of W2 to be different each other. Owing to this, it is possible to secure the structure that is easily displaced toward the inside and has high safety.

In the mean time, a supporting device of alignment member 102 is also the same as explained earlier, with respect to directions W1 and W2, they are opposite to the occasion of the alignment member 101. Namely, direction W1 is a direction toward the inside, and direction W2 is a direction toward the outside.

What is claimed is:

1. A sheet ejection device comprising:

a sheet ejection tray adapted to stack a sheet ejected thereon;

an alignment member which aligns a position in a width direction of the sheet, which is perpendicular to a sheet ejection direction of the sheet on the sheet ejection tray; and a supporting unit which pivotally supports the alignment member around a shaft provided in parallel with the sheet ejection direction so that the alignment member is displaceable by being rotated around the shaft in at least one of an outward direction with respect to a stacking area in which the sheet on the ejection tray is stacked and an inward direction with respect to the stacking area when outer force is applied to the alignment member in the width direction of the sheet, which is perpendicular to the sheet ejection direction.

2. The sheet ejection device of claim 1, wherein the alignment member is displaceable in the outward direction and the inward direction, and the supporting unit supports the alignment member so that displacement resisting force when the alignment member is displaced in the outward direction is larger than stress caused by the sheet when the alignment member comes in contact with the sheet on the ejection tray and aligns the sheet.

3. The sheet ejection device of claim 2, wherein the supporting unit supports the alignment member so that the displacement resisting force when the alignment member is displaced in the outward direction is larger than a displacement resisting force when the alignment member is displaced in the inward direction.

4. The sheet ejection device of claim 1, wherein the supporting unit comprises a spring which restores a position before the alignment member has been displaced when the outer force is released while a displacement state of the alignment member is maintained.

5. The sheet ejection device of claim 1, wherein the shaft is provided at an end portion on an upstream side of the alignment member in the sheet ejection direction.

6. The sheet ejection device of claim 1, wherein a pair of the alignment members are provided, and the sheet ejection device further comprises a shift member which shifts the pair of alignment members in a direction that is perpendicular to the sheet ejection direction and horizontal to a surface of the sheet on the ejection tray.

7. The sheet ejection device of claim 6, wherein the shift member sets the pair of alignment members at a plurality of shift positions, and reciprocates one of the pair of alignment members along the sheet width direction according to the plurality of shift positions.

8. The sheet ejection device of claim 1, wherein the alignment member is adapted to be capable of being receded in a direction separating from the ejection tray with respect to an alignment position of the sheet on the ejection tray, and capable of being receded after a series of job sheets that have been ejected are aligned.

9. An image forming apparatus comprising the sheet ejection device of claim 1.

10. A sheet finisher comprising the sheet ejection device of claim 1.

* * * * *